US005829719A

United States Patent [19]

Han

[11] Patent Number: 5,829,719

[45] Date of Patent: Nov. 3, 1998

[54] GOLF BAG WITH SUPPORT STAND

[76] Inventor: Dong Kyu Han, 219 S. Primrose St., Anaheim, Calif. 92804

[21] Appl. No.: 768,210

[22] Filed: Dec. 17, 1996

[51] Int. Cl.[6] ..... A63B 55/00

[52] U.S. Cl. ..... 248/96; 206/315.7

[58] Field of Search ..... 248/96, 188.3, 248/143; 206/315.7, 315.8

[56] References Cited

U.S. PATENT DOCUMENTS

| | | | |
|---|---|---|---|
| 2,430,107 | 11/1947 | Cronrath | 248/143 X |
| 4,620,682 | 11/1986 | Yim | 248/96 |
| 4,921,192 | 5/1990 | Jones | 248/96 |
| 5,152,483 | 10/1992 | Maeng | 248/96 |
| 5,154,377 | 10/1992 | Suk | 248/96 |
| 5,186,424 | 2/1993 | Shultz et al. | 248/143 X |
| 5,209,350 | 5/1993 | Maeng | 206/315.7 |
| 5,340,063 | 8/1994 | Hsieh | 248/96 |
| 5,464,180 | 11/1995 | Cheng | 248/96 |
| 5,507,384 | 4/1996 | Maeng | 206/315.7 |
| 5,516,064 | 5/1996 | Hsich | 248/96 |
| 5,549,263 | 8/1996 | Maeng | 248/96 |
| 5,607,128 | 3/1997 | Suk | 206/315.7 X |

*Primary Examiner*—Ramon O. Ramirez

[57] ABSTRACT

A golf bag according to present invention comprises a bag body, a support stand assembly and a base plate. The bag body has a lower member which has an inclined bottom surface for easy tilting of the bag in relation to the base plate. The none inclined bottom surface of the lower member and the base plate provides a sufficiently large contact area with the ground to provide stable support for the tilted golf bag even on uneven or sloped surface. The golf bag also includes a resilient support spine mounted to the bag body for installing the support stand assembly. The support stand may be mounted either in the interior or on the exterior of the golf bag.

18 Claims, 5 Drawing Sheets

GOLF BAG WITH SUPPORT STAND

BACKGROUND OF THE INVENTION

1. Field of the Invention

This invention relates to golf bags, and more particularly to golf bags with extendable and retractable support stands which act in cooperation with a base plate to support the golf bag at an angle.

2. Description of Related Art

Golf is one of the most widely played sports activities in the United States. Not only is this activity already widespread, but the number of golfers continue to grow due to popularity of the sports caused by high stake games televised on televisions.

The sport of golf is typically played with a set of golf clubs which are commonly placed in a golf bag. When a golf bag is carried by a golfer, it is desirable to include a stand which supports the golf bag in its upright position to allow easy access to the golf clubs. Conventionally, this function has been accommodated by providing legs which are extendable when the golf bag is placed on the ground and retractable when the golf bag is carried.

Various methods have been used to move the legs between their retracted and extended positions. One method is described in U.S. Pat. No. 5,154,377 to Suk (the "Suk reference"). In the Suk reference, before a pair of legs can be used to support a golf bag, a slide member must be moved in a descending position along a two parallel groove track formed in a slide bracket. When the extending feature of the legs are not needed, the user must then manually move the slide member in an upward position along the track. The manual operation of the sliding member may be cumbersome to some golfers.

Another conventional golf bag stand is described in U.S. Pat. No. 5,152,483 to Maeng (the "Maeng reference"). In the Maeng reference, the pair of legs extend away from the golf bag to provide support when the golf bag is forcefully tilted with respect to the ground. In such a position, the contact surface area of the golf bag with the ground is minimal, which comprises the tips of two legs and an edge of the golf bag, and thus possible causing the golf bag to tip over when it is placed on a slope or irregular surface. In addition, a horizontal drive member pivotally mounted to a base of the golf bag in the Maeng reference must be sufficiently rigid and large to withstand the tilting force, because the drive member must provide all of the actuating force to the U-shaped actuating member.

Moreover, the conventional golf bags having a support stand are heavier due to the added weight of the support stand and a resilient tubing of the golf bag body which must be used to mount the support stand.

SUMMARY OF THE DISCLOSURE

Accordingly, it is an object of the present invention to provide a golf bag having integral legs which act in cooperation with a base plate of the golf bag to support the golf bag at an acute angle. It is a further object of the present invention to provide such a golf bag which is light weight.

In accordance with the present invention, these objects can be accomplished by providing a golf bag stand suitable for use with a golf bag having a bag body. According to one embodiment of the present invention, the golf bag stand comprises a bottom member coupled to a lower portion of the bag body, in which the bottom member has an inclined surface and a planar surface substantially normal to the upright axis of the bag body. The golf bag stand further includes a spine longitudinally installed to the bag body and a mount attached to the spine, wherein the mount defines a first set of engaging members and a second set of engaging members. Legs are pivotally attached to the first set of engaging members. The golf bag stand also has an actuating member having lower and upper members, wherein the upper member is pivotally connected to the second set of engaging members, and a base plate pivotally attached to the bottom member. The base plate has a connector which couples the lower member of the actuating member. The base plate is sufficiently large to cover the inclined surface and the planar surface of the bottom member. The inclined surface operates in cooperation with the base plate to permit a tilting movement of the golf bag to tilt the golf bag at a predetermined angle with respect to the upright axis of the bag body.

According to one aspect of the preferred embodiment, the support spine mounted on the bag body may be longitudinally installed either on an exterior or in an interior of the bag body for attaching the mount.

In the preferred embodiment of the present invention, the support spine has a shape of a rectangular bar. The golf bag stand also has a top bracket and a bottom bracket mounted on the bag body to securely hold the support spine.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
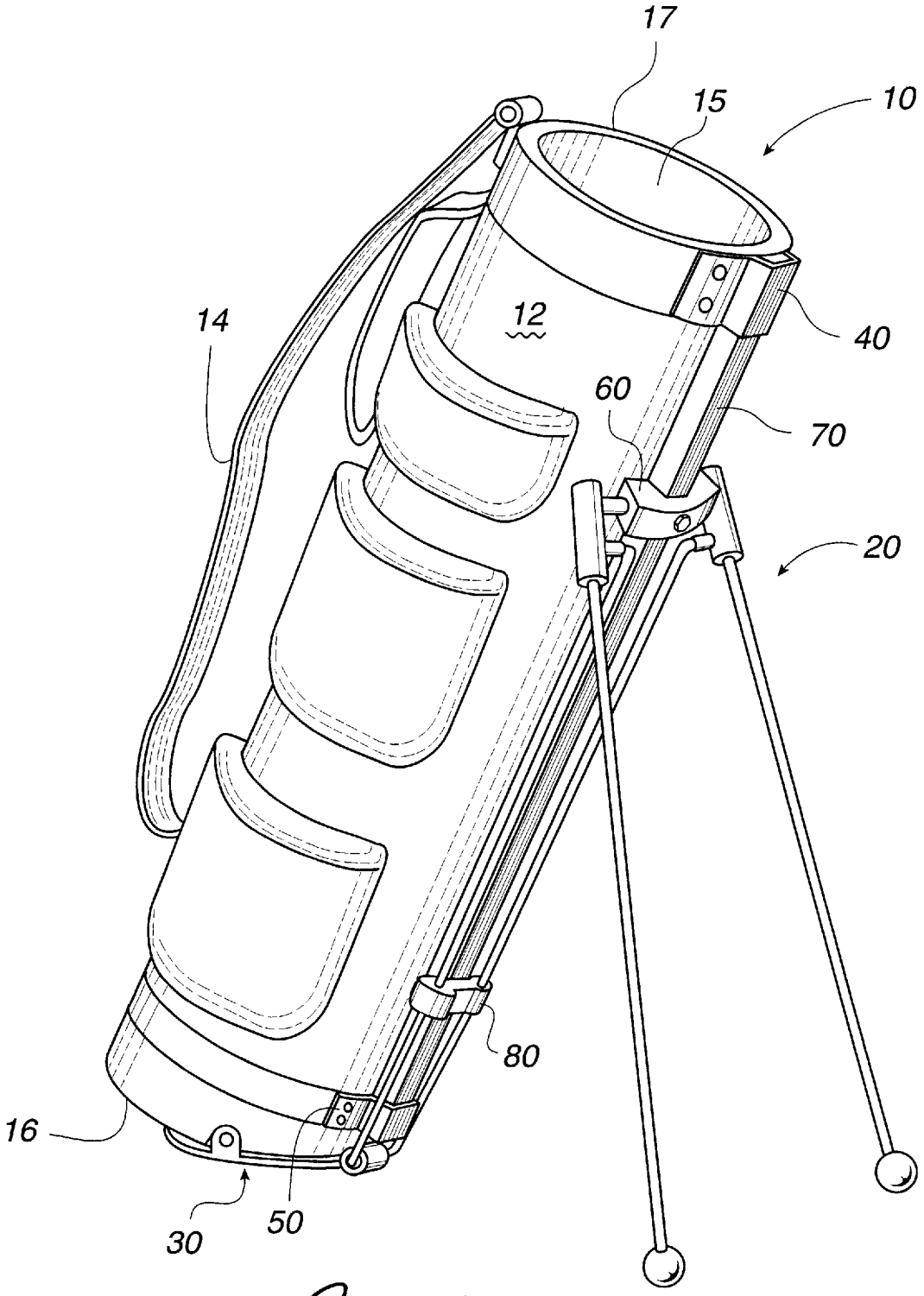
FIG. 1 illustrates a perspective view of a golf bag stand according to the preferred embodiment of the present invention.

A golf bag with a support stand according to an embodiment of the invention is shown in the drawings for purposes of illustration. Referring to FIG. 1, there is shown a golf bag 10 which has a bag body 12 provided with a shoulder strap 14, a support stand assembly 20 and a base plate 30. The support stand assembly 20 is mounted on the bag body.12 on the side opposite of the where the shoulder strap 14 is mounted, as illustrated in FIG. 1. In the preferred embodiment, the support stand assembly 20 is mounted on a support spine 70 which is mounted on the exterior of the bag body 12 in the direction of the elongated axis formed by the bag body 12.

In the preferred embodiment, the bag body 12 is of a substantially cylindrical shape with a top opening 15 for receiving golf clubs and a bottom member 16 fully enclosing the lower opening of the bag body 12. The bag body 12 is made of any resilient, flexible and light weight material, such as nylon or canvas. The top portion of the bag body 12 includes a top member 17, preferably made with any cylindrically hollow and rigid material, such as injection molded plastic, and is affixed to the bag body 12 to define the top opening 15. The bottom member 16 is also preferably made with injection molded plastic to provide firm bottom support to the bag body 12.

Figure 2:
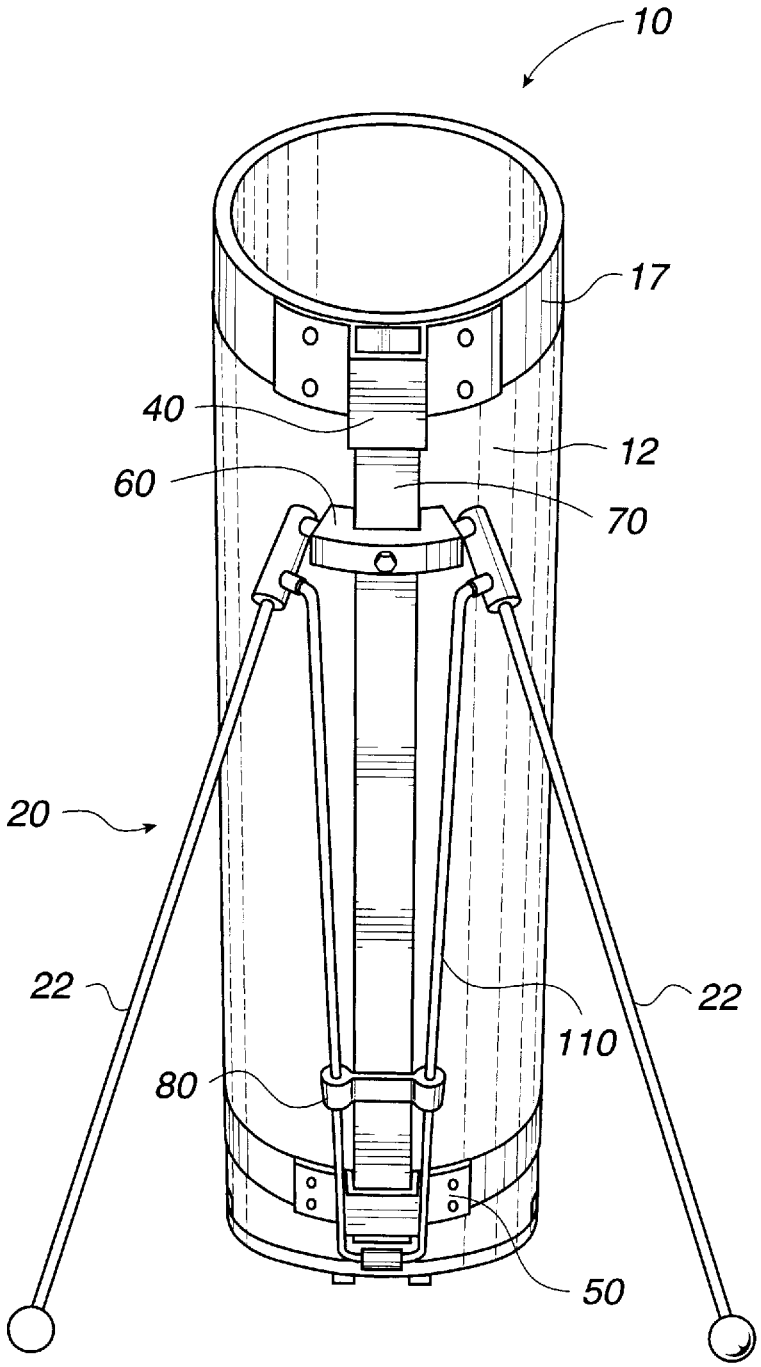
FIG. 2 is a front elevational view of FIG. 1.
Figure 3:
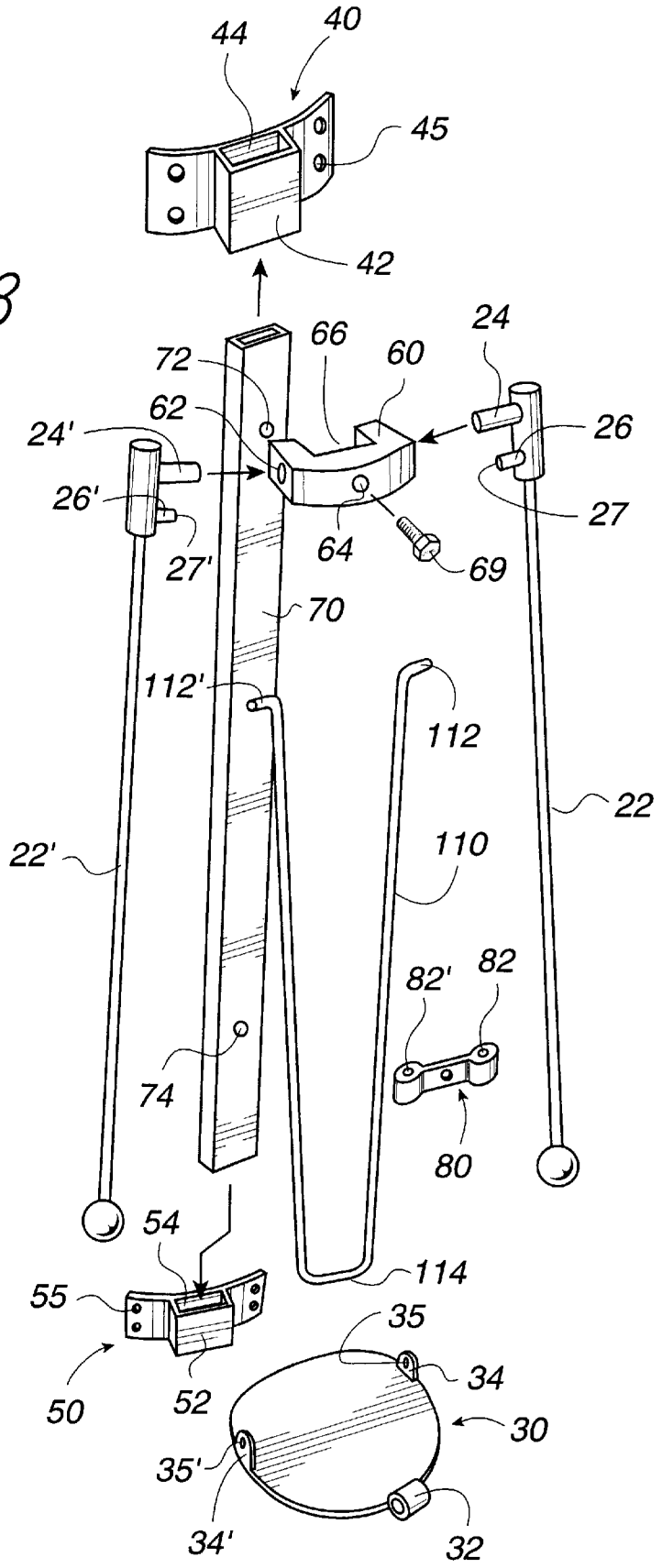
FIG. 3 exploded view of the golf bag stand as shown in FIG. 1.

Referring to FIG. 2, there shown is a front elevational view of the support stand assembly 20 according to the preferred embodiment of the present invention. Attached to the top member 17 is a top bracket 40. Similarly, the bottom bracket 50 is attached to the bottom member 16. Both the top and bottom brackets 40, 50 may be respectively fastened to the top and bottom member 17, 16 using any suitable fastener, such as rivets, screws or adhesives. The top bracket 40 has a raised enclosure 42 having, preferably, an elongated rectangular hole 44 for receiving the upper portion of the support spine 70, as shown in FIG. 3. The rectangular hole is configured to snugly fit therein the support spine 70. The top bracket 40 also has a plurality of mounting holes 45 for attaching the top bracket 40 to the top member 17 using any suitable fasteners.

The bottom bracket 50 has a similar shape as that of the top bracket 50, but may be slightly smaller in elongated length. The bottom bracket 50 has a raised enclosure 52 for receiving the lower portion of the support spine 70, as shown in FIG. 3. The bottom bracket 50 has a rectangular hole 54 for receiving the support spine 70 and a plurality of mounting holes 55 for attaching the bottom bracket 50 to the bottom member 16 using any suitable fastener. The top and bottom brackets 40 and 50 may be made of any rigid and light weight material, such as injection molded plastic or aluminum.

Before installing the top 40 and bottom 50 brackets onto the bag body 12, it is preferable to install the support spine 70 into the rectangular holes 44 and 54. The completed assembly consisting of the top bracket 40, support spine 70 and bottom bracket 50 are mounted on the exterior of the bag body 12 to provide a rigid frame for the golf bag 10. This construction allows the golf bag 10 according to the preferred embodiment to be manufactured without the use of a conventional rigid inner cylindrical tube which is heavy and expensive to make. Alternatively, although not illustrated in the drawings, the support spine 70 may be installed in the interior of the bag body 12 with suitably configured top bracket 40 and the bottom bracket 50 so that the support spine 70 is hidden from the view.

The construction of the support spine 70 is now discussed in detail. The support spine 70 has an upper hole 72 for receiving a mount 60 and a lower hole 74 for receiving a guiding bracket 80, as shown in FIG. 3. The support spine 70 preferably has a hollow interior and may be formed of any rigid material, such as aluminum or plastic. Alternatively, the combined structure of the support spine 70, mount 60 and guiding bracket 80 may be formed of one-piece mold made of any rigid material, such as plastic, aluminum or steel. In another alternative embodiment, the support spine 70 and the bottom member 16 may be formed of one-piece mold of any rigid material.

As illustrated in FIG. 2 and described above, the mount 60 is fixedly mounted on the support spine 70 at a suitable elevation. In the preferred embodiment, the mount 60 is installed on the support spine 70 using a fastener, such as a screw 69. The mount 60 includes two axle holes 62 (one of the axle holes is not shown in FIG. 3) disposed in substantially horizontal direction, open at respective outer end and mounting hole 64 which extends from one end of the mount 60 to the other end for inserting a fastener, such as a screw or a bolt. The mount further includes a receptor 66 configured and designed for fixedly mounting the mount 60 to the support spine 70. There are two legs 22 and 22', each leg having a pin 24 or 24' substantially perpendicularly disposed near the top end and respectively fitted into the axle hole 62 in the mount 60. As a result, the two legs 22 and 22' can extend away from or retract toward the bag body 12, pivoting at the axle holes. Each leg 22 or 22' has a bore casing 26 or 26' with a through bore 27 or 27' for mounting an actuating member 110.

The actuating member 110 has two opposing ends 112 and 112' disposed at the same elevation and respectively inserted through the through bores 27 and 27' in the bore casing 26, 26'. The actuating member 110 is preferably made of heavy gauge spring wire and is formed of a substantially U-shape. The actuating member 110 has a base portion 114 equally spaced from the two opposite ends 112 and 112'. The base portion 114 is hooked to a connector 32 of the base plate. The guiding bracket 80, which is securely attached to the support spine 70 with any suitable fastener, such as a screw or welded, has two holes 82 and 82', for inserting respective legs 22 and 22' of the actuating member 110.

Figure 4:
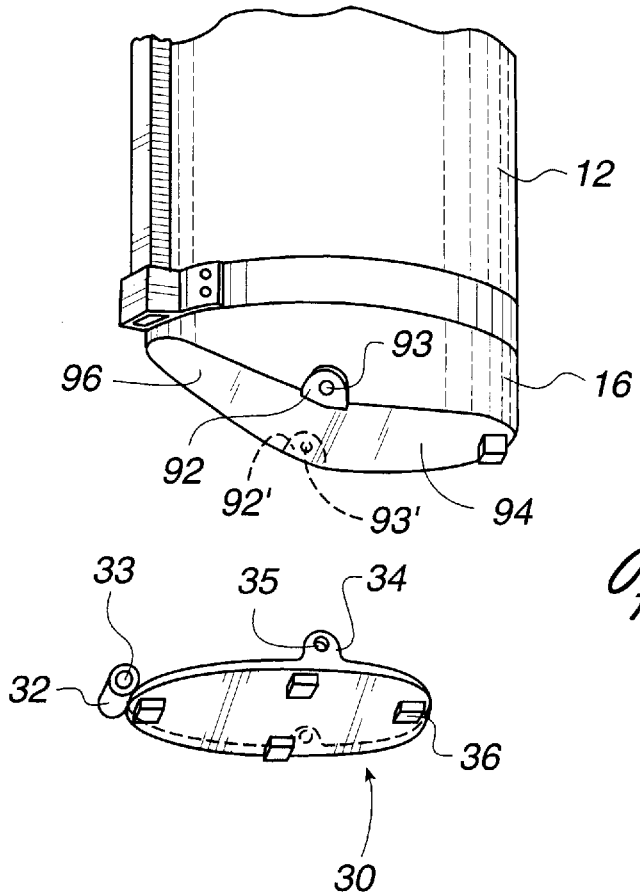
FIG. 4 illustrates the lower portion of the golf bag stand which particularly illustrates the construction of the base plate and the bottom member.

Referring to FIGS. 3 and 4, there provided a base plate 30 according to the preferred embodiment of the present invention. The base plate 30 is formed of a substantially circular plate matching the cross sectional shape of the bottom member 16. The base plate 30, however, is preferably slightly smaller in cross sectional area than that of the bottom member 16, as shown in FIG. 4. The base plate 30 comprises two axle members 34 and 34', each having a through hole 35 or 35'. The distance between the two axle members 34 and 34' is substantially equal to that of the two receptacles 92 and 92' formed on each lower side of the bottom member 16. As described above, the base plate 30 has a connector 32 for engaging the base portion 114 of the actuating member 110. The diameter of the hole 33 defined by the connector 32 is preferably slightly larger than the cross section of the base portion 114 of the actuating member 100 to allow free pivoting movement of the base portion 114. In the preferred embodiment, the connector 32 and the base plate 30 are formed as one-piece mold. Alternatively, the connector 32 may be separately formed and attached to the base plate 30 with any suitable fastener, such as rivets, screws or adhesives. On the lower surface of the base plate 30, there is a plurality of pads 36 to support the base plate 30. The plurality of pads 36 may be formed as one-piece construction with the base plate 30.

Figure 5A:
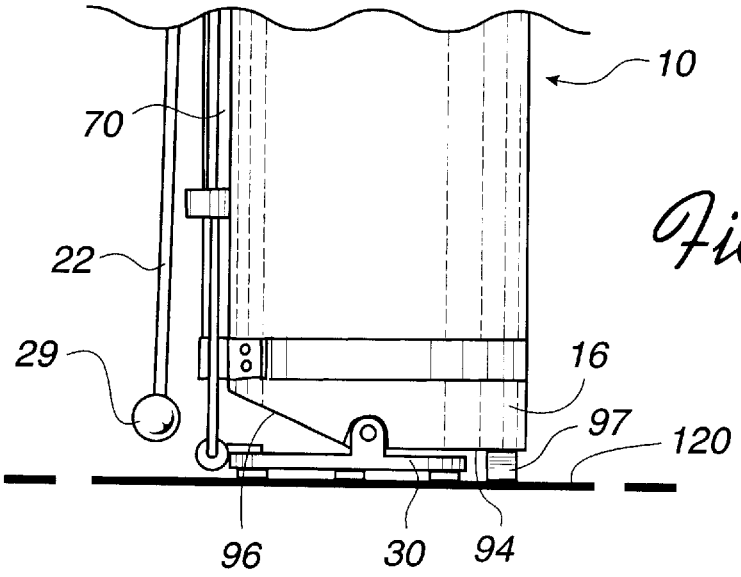
FIG. 5*a* illustrates the golf bag stand in an upright position.

Referring to FIG. 4, the bottom member 16 of the golf bag 10 according to the preferred embodiment has a first portion 94 which is a planar surface perpendicular with respect to the upright position of the bag body 12 and a second portion 96 which is an inclined surface formed from the first portion 94 at a predetermined angle. In a preferred embodiment, the predetermined angle is approximately 25–35 degrees. The base of the bottom member 16 is divided approximately equally between the first portion 94 and the second portion 96. The receptacles 92 and 92' are formed at the junction where the first portion 94 and the second portion 96 join, as shown in FIG. 4. The base plate 30 is attached to the bottom member 16 by inserting preferably a pin through each respective through hole 35 or 35' and the receptor hole 93 or 93'. When properly installed, the connector 32 of the base plate 30 protrudes out of the boundary defined by outer rim of the bottom member 16, so that the actuating member 110 may be installed, as shown in FIG. 5*a*. Such compact design of the combined structure of the base plate 30 and the actuating member 110 allows the golf bag 10 to be easily hand carried or placed on a golf cart without the hassle of parts protruding from the golf bag 10. Since cross section of the base plate 30 is smaller than that of the bottom member 16, a pad 97 is affixed to the suitable position of the first portion 94 to further provide support for the golf bag 10 when the golf bag 10 is in substantially upright position.

Figure 5B:
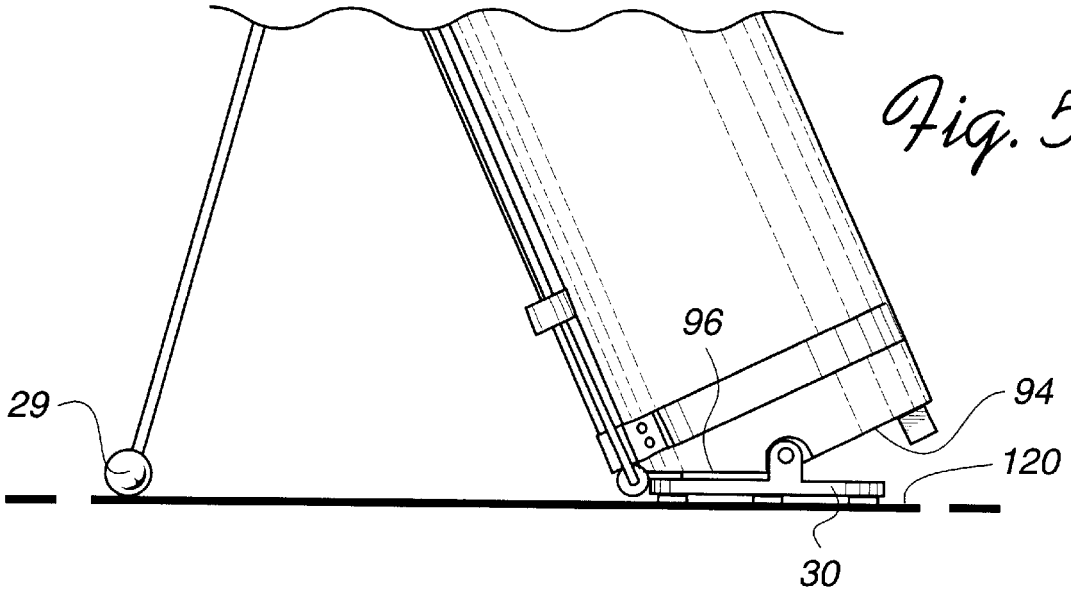
FIG. 5*b* illustrates the golf bag stand in a tilted position.

FIGS. 5*a* and 5*b* illustrate the operation of the support stand assembly 20 according to the preferred embodiment. The legs 22 and 22' of the golf bag 10 of the preferred embodiment are normally in their retracted position adjacent to the side of the golf bag 10, as shown in FIG. 5*a*. In this position, the golf bag 10 is supported by the first portion 94 of the bottom member 16 and the base plate 30, thus creating a substantially full contact with the surface 120. To bring the legs 22 and 22' into their extended position, such as when a golfer places the golf bag 10 on the ground, the second portion 96 of the golf bag 10 is pushed toward the surface 120, which in turn tilts the base plate 30 toward the second portion 96. This is accomplished by tilting the golf bag 10 until the second portion 96 of the bottom member 16 is approximately parallel with the ground and the bottom 29 of the actuating member 110 in contact with the ground. The golf bag 10 is tilted until the second portion 96 is in contact with the upper surface of the base plate 30, thus extending the legs 22 and 22'.

Figure 5C:
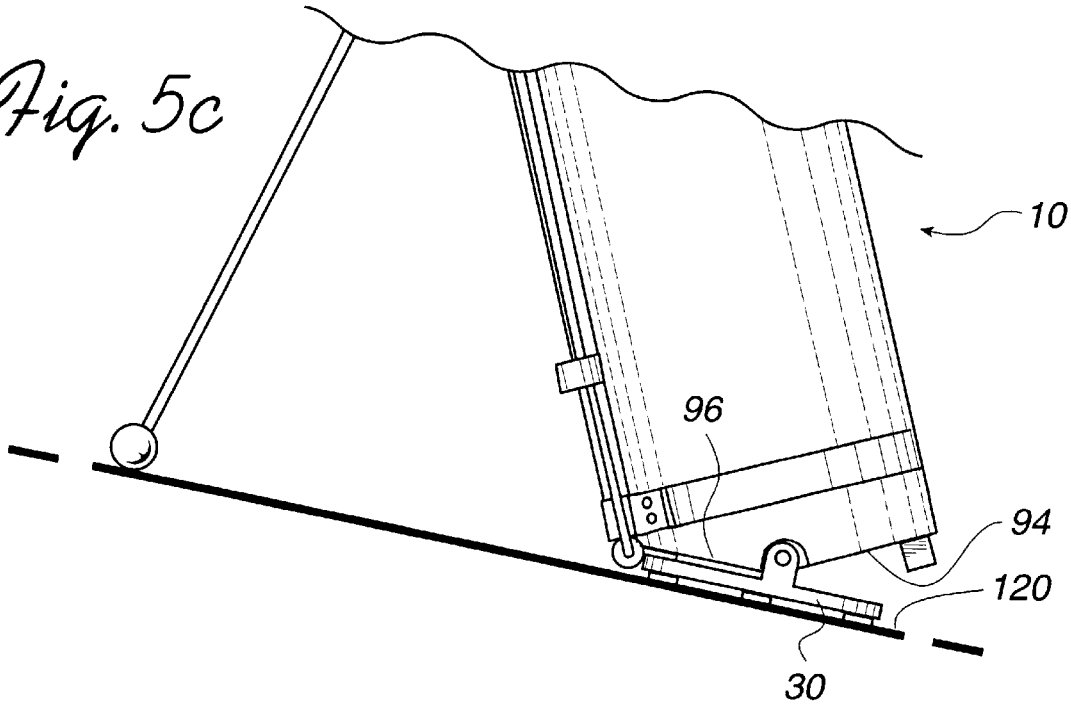
FIG. 5*c* illustrates the operation of the support stand assembly on a sloped surface.

FIG. 5*c* illustrates the operation of the support stand assembly 20 on a sloped surface. As shown, despite the sloped surface, the base plate 30 makes a full contact with the surface, thus providing a stable support for the golf bag 10.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A golf bag with a stand comprising:

a bag body;

a bottom member coupled to a lower portion of the bag body, wherein the bottom member has an inclined surface and a planar surface and has a pivot hole where the inclined surface are joined with the planar surface;

a mount secured to the golf bag, the mount having a first set of engaging members;

legs having a second set of engaging members, wherein the legs are respectively and pivotally attached to the first set of engaging members of the mount;

an actuating member having lower and upper members, wherein the upper member is pivotally connected to the second set of engaging members of the legs; and a base plate pivotally attached to the pivot hole of the bottom member so that when the golf bag is tilted toward the direction of the inclined surface, the base plate is positioned substantially parallel to the inclined surface of the bottom member and when the golf bag is standing upright then the base plate is positioned substantially parallel to the planar surface of the bottom member, wherein the lower member of the actuating member is coupled to the base plate, and wherein a pivoting movement of the base plate actuates the actuating member.

2. A golf bag of claim 1, further comprising a spine longitudinally installed on an exterior of the bag body for securing the mount.

3. A golf bag of claim 2, wherein the spine has a polygonal cross-section.

4. A golf bag of claim 2, further comprising a top bracket and a bottom bracket mounted on the bag body to securely hold the spine.

5. A golf bag of claim 1, further comprising a spine longitudinally installed in an interior of the bag body for securing the mount.

6. A golf bag of claim 1, wherein the actuating member is a U-shaped rod.

7. A golf bag of claim 1, wherein the base plate is slightly larger than the inclined surface to cover the inclined surface and the planar surface of the bottom member.

8. A golf bag of claim 1, wherein the base plate has a connector for engaging the lower member of the actuating member.

9. A golf bag of claim 8, wherein the base plate and the connector are formed as an one-piece member.

10. A golf bag with a stand, the golf bag comprising:

a bottom member coupled to a lower portion of the bag body, the bottom member having an inclined surface and a planar surface substantially normal to the upright axis of the bag body, wherein the bottom member has a pivot hole where the inclined surface are joined with the planar surface;

a spine longitudinally secured to the bag body;

a mount attached to the spine, the mount defining a first set of engaging members;

legs having a second set of engaging members, wherein the legs are pivotally attached to the first set of engaging members;

an actuating member having lower and upper members, wherein the upper member is pivotally connected to the second set of engaging members; and a base plate pivotally attached to the pivot hole of the bottom member so that when the golf bag is tilted toward the direction of the inclined surface, the base plate is positioned substantially parallel to the inclined surface of the bottom member and when the golf bag is standing upright then the base plate is positioned substantially parallel to the planar surface of the bottom member, wherein the base plate has a connector which couples the lower member of the actuating member, and wherein the base plate covers the inclined surface and the planar surface of the bottom member, and wherein the inclined surface pivots with respect to the base plate to permit a tilting movement of the golf bag to tilt the golf bag at a predetermined angle with respect to the upright axis of the bag body.

11. A golf bag of claim 10, further comprising a top bracket and a bottom bracket mounted on the bag body to securely hold the spine.

12. A golf bag of claim 10, wherein the actuating member is a U-shaped rod.

13. A golf bag of claim 10, further comprising a spine longitudinally installed on an exterior of the bag body for securing the mount.

14. A golf bag of claim 10, further comprising a spine longitudinally installed in an interior of the bag body for securing the mount.

15. A golf bag of claim 10, wherein the spine has a polygonal cross-section.

16. A golf bag with a stand, the golf bag comprising:

a base secured to a bottom portion of the bag body, the base having an inclined surface and a planar surface, wherein the base has a pivot hole where the inclined surface are joined with the planar surface;

a spine having a first set of engaging members, wherein the spine is longitudinally secured to the bag body;

legs having a second set of engaging members, wherein the legs are pivotally attached to the first set of engaging members of the spine;

an actuating member having lower and upper members, wherein the upper member is pivotally connected to the second set of engaging members; and a base plate pivotally attached to the pivot hole of the base so that when the golf bag is tilted toward the direction of the inclined surface, the base plate is positioned substantially parallel to the inclined surface of the bottom member and when the golf bag is standing upright then the base plate is positioned substantially parallel to the planar surface of the bottom member, wherein the base plate has a connector which couples the lower member of the actuating member, and wherein the inclined surface pivots with respect to the base plate to permit a tilting movement of the golf bag to tilt the golf bag at a predetermined angle with respect to the upright axis of the bag body.

17. A golf bag of claim 16, wherein the base and the spine are formed as one integral piece.

18. A golf bag of claim 16, further comprising a top bracket and a bottom bracket mounted on the bag body to securely hold the spine.

* * * * *